United States Patent [19]

Buchman et al.

[11] Patent Number: 5,020,302

[45] Date of Patent: Jun. 4, 1991

[54] ROLL INSERTER

[75] Inventors: James E. Buchman, Hortonville; Gregory J. Vanden Heuvel, Kaukauna, both of Wis.

[73] Assignee: Reynolds Consumer Products, Inc., Appleton, Wis.

[21] Appl. No.: 583,827

[22] Filed: Sep. 17, 1990

[51] Int. Cl.[5] ..... B65B 25/14

[52] U.S. Cl. ..... 53/430; 53/118; 53/241; 53/473; 53/566

[58] Field of Search ..... 53/430, 473, 119, 118, 53/566, 564, 204, 409, 241, 258, 260, 255

[56] References Cited

U.S. PATENT DOCUMENTS

| | | | |
|---|---|---|---|
| 2,092,786 | 9/1937 | Taylor . | |
| 2,314,434 | 3/1943 | Toelke et al. | 53/566 X |
| 2,720,055 | 10/1955 | Morris . | |
| 2,741,884 | 4/1956 | Best | 53/241 X |
| 3,458,966 | 8/1969 | Dunbar et al. . | |
| 3,763,619 | 10/1973 | Stone . | |
| 3,826,361 | 7/1974 | Heckrodt | 206/409 |
| 4,223,510 | 9/1980 | Cash | 53/258 |
| 4,235,063 | 11/1980 | Paetz | 53/258 X |
| 4,300,327 | 11/1981 | Bridger | 53/258 |
| 4,811,548 | 3/1989 | Reist | 53/204 X |

OTHER PUBLICATIONS

Egan Newsletter, vol. 6, No. 4, Fall 1971, pp.1–4.

*Primary Examiner*—James F. Coan

*Attorney, Agent, or Firm*—Willian, Brinks, Olds, Hofer, Gilson & Lione

[57] ABSTRACT

A roll of plastic bags is inserted into an empty carton using a finger body having a finger that radially extends to securely grip the inside of the roll. The roll is drawn into an already formed empty carton where the finger is lowered and the finger body is retracted so that the roll of bags is automatically packaged.

22 Claims, 3 Drawing Sheets

ROLL INSERTER

BACKGROUND OF INVENTION

This invention relates to an apparatus for inserting a cylindrical roll of material into a carton. More particularly, it relates to an apparatus for inserting a cylindrical roll of plastic bags into a packaging carton.

In the packaging of plastic bags, the bags, after they have been formed and sometimes folded, are typically wound onto a winding spindle to form a roll of bags. The bags can be wound around a core, such as a cardboard cylinder. It is not necessary, however, to use a core. One such process for preparing the bags to be packaged is described in U.S. Pat. No. 3,826,361 issued Jul. 30, 1974, and assigned to the same assignee as is the present invention.

After the bags are wound, they are inserted into a packaging carton, usually made of cardboard, in either of two ways. First, they can be inserted manually, which decreases the number of packages that can be formed in a given time and increases the total cost.

Second, a machine may be used to grip the outside of the roll of bags and automatically insert the roll into a carton. A disadvantage of this method is that the carton must necessarily be sufficiently large to accommodate the roll and the gripper mechanism so that the gripper can hold the roll until the roll is inside the carton, where the gripper then releases it. Because the size of the carton must be overly large as compared to the size of the roll to accommodate the gripper, more material must be used to form the carton, thus increasing the total cost of the carton, as well as increasing the space needed to transport and store the cartons.

There has, therefore, been a need for a means to automatically insert a roll of bags into a carton in an economical fashion. The present invention provides a means for gripping the inside of the roll to insert it into a carton. With the mechanism of the present invention, rolls can be automatically inserted into cartons that are only slightly larger than the outside diameter of the roll.

SUMMARY OF THE INVENTION

The present invention provides an apparatus that inserts a roll of material into an empty carton. The apparatus has a means for gripping the inside of the roll and a means for activating and deactivating the gripping means so that when the gripping means is activated it grips the inside of the roll. The apparatus also has a means for reciprocating the gripping means along a path having a first end and a second end. Between the two ends, a carton formation station opens folded cartons in cooperation with the gripping means so that when the gripping means is at the first end it is activated to grip a roll of material. Thereafter, the roll is drawn into the already open carton where the gripping means is deactivated to release the roll inside the carton. The gripping means then proceeds to the second end where it is outside the carton.

A preferred embodiment of the present invention provides a finger body having a gripping finger that is inserted into the hole formed by the roll of bags or into the inside of the core upon which the bags are wound. The gripping finger is radially extended to contact the inner annulus to securely hold the roll. Prior to inserting the gripping finger into the roll, a cooperating machine opens a partially folded carton. The finger body is thrust through the open ends of the carton, and the roll is stripped off of a winding spindle onto the finger body. The gripping finger is then activated and the roll is then drawn into the empty carton where the gripping finger is lowered into the finger body. The finger body is then retracted away from the roll so that the roll is inserted into the carton. Thus, the roll of bags is automatically packaged into a carton which is only slightly larger than the outside diameter of the roll, thereby saving on the total cost of making the bags.

DETAILED DESCRIPTION OF THE INVENTION AND PREFERRED EMBODIMENTS

Figure 1:
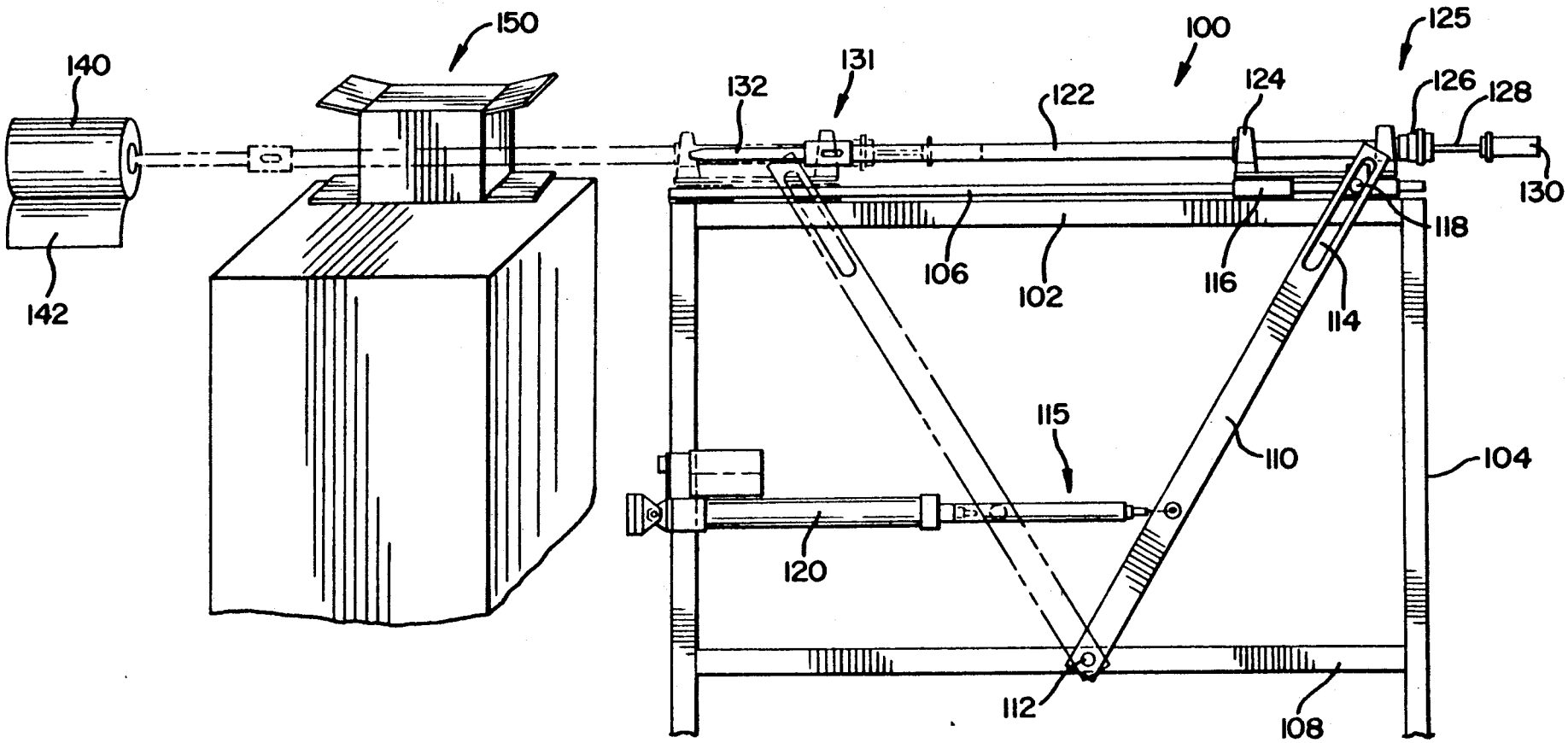
FIG. 1 is a perspective view of the preferred embodiment of the invention.
Figure 2:
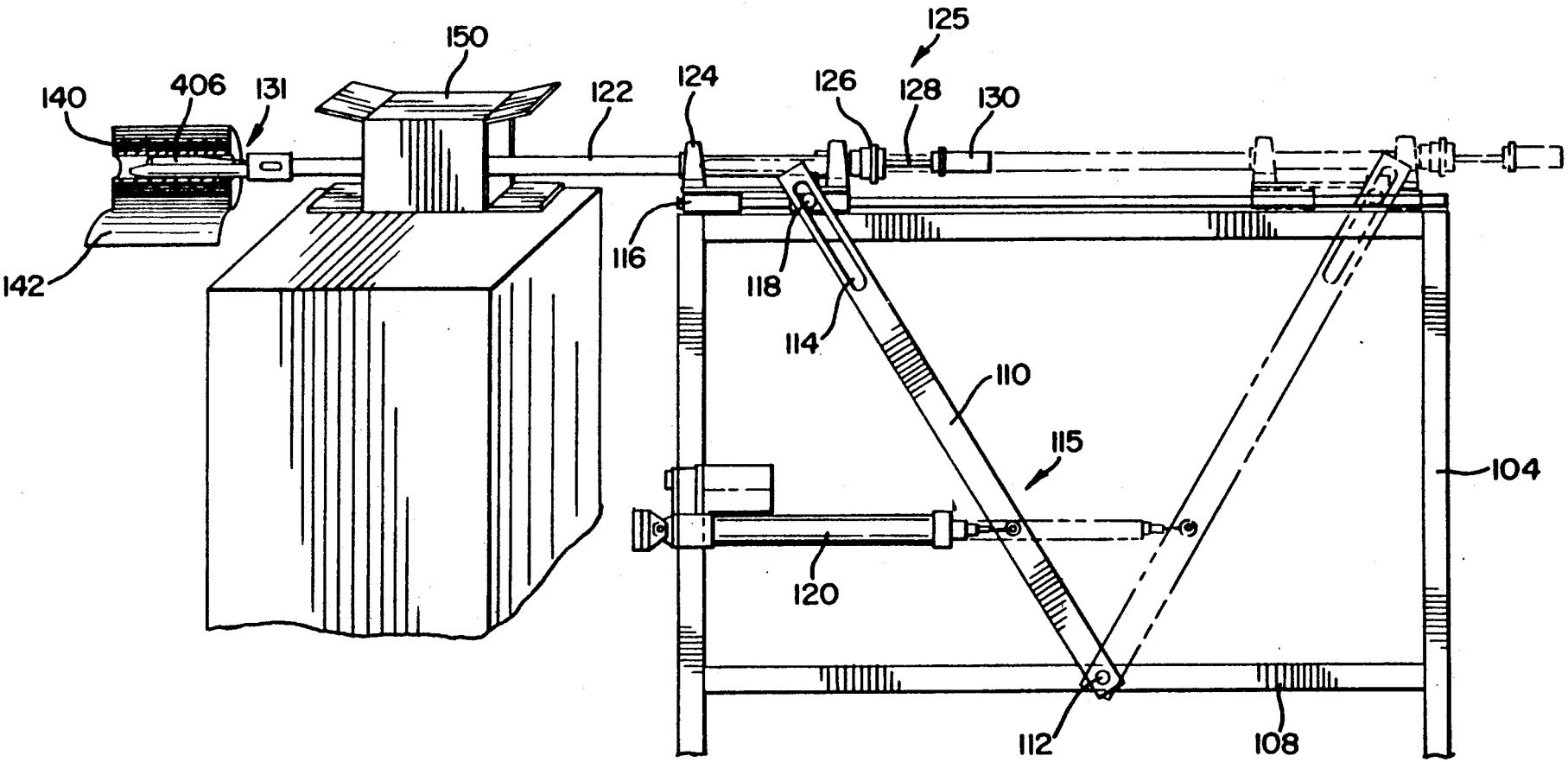
FIG. 2 is a perspective view of the roll inserter of FIG. 1 with a roll being gripped.

FIG. 1 shows a roll inserter apparatus 100 for inserting a roll of material 140, for example, a roll of plastic bags, into an empty carton 150 formed by a means for opening a folded carton at a carton formation station. The apparatus 100 consists generally of a means for gripping 131 used to grip the inside of a roll 140 (including its core, if any), a means for reciprocating the gripping means 115 so that the means for gripping 131 can be moved along a path having two ends; a first end or a forward position (shown in dashed lines in FIG. 1) and a second end or a retracted position (shown in solid lines in FIG. 1), and, a means for activating and deactivating the gripping means 125.

Figure 3:
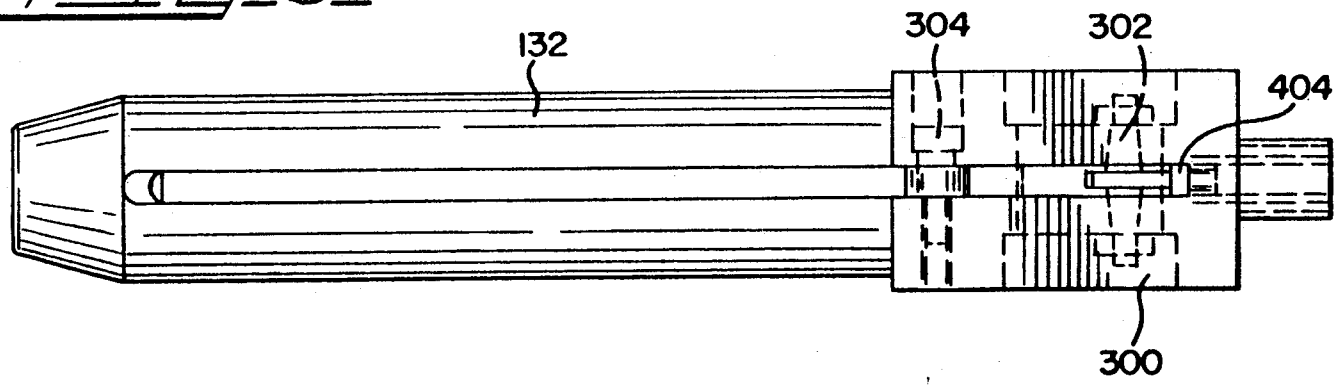
FIG. 3 is an enlarged cross section of the top of the finger body of the roll inserter of FIG. 1.
Figure 4:
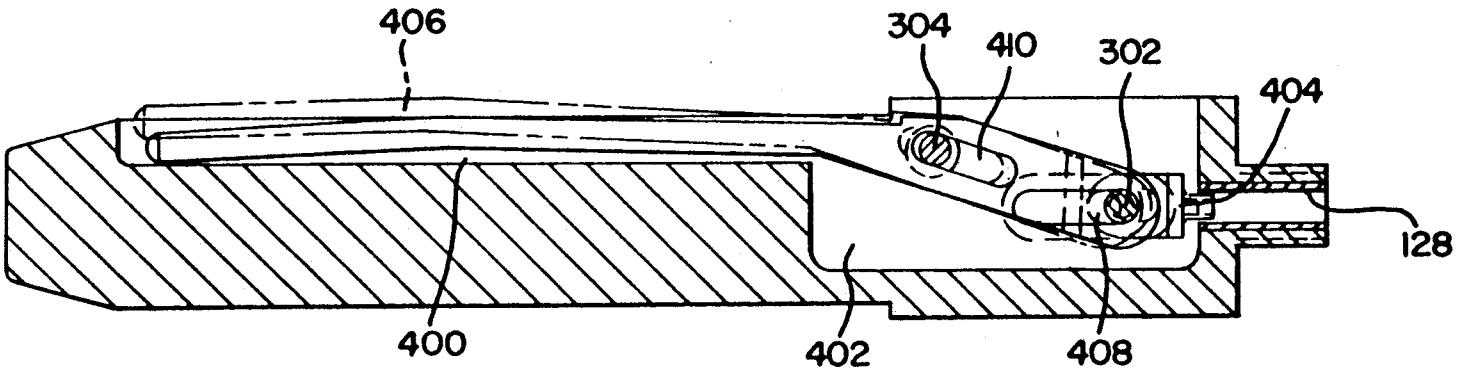
FIG. 4 is an enlarged cross section of the side of the finger body of the roll inserter of FIG. 1.

Preferably, the means for gripping 131 includes a cylindrical finger body 132 and a finger 406. As shown in FIGS. 3 and 4, the finger body 132 is tapered at the distal end. Preferably, the diameter of the finger body 132 is slightly smaller than the inside diameter of the roll 140 (including its core, if any) so that the finger body can easily fit into the roll. The finger body 132 has a finger body groove 400 that extends substantially the length of the body 132. At the proximal end of the body 132, there is a cavity 402 having open sides 300 opposite each other.

The movable finger 406, when in one position, rests inside the groove 400. The finger 406 is slightly angled inward at the distal end so that when the finger 406 is raised or radially extended, the distal end is substantially parallel to the finger body 132. At the proximal end, the finger 406 extends downward and has two guide openings 408 which surround a clevis 404 and correspond to the opening of the clevis 404. In addition, finger 406 has an oblong opening 410 provided above and forward of the guide openings 408.

A finger guide shaft 302 extends through the guide openings 408 and the opening in the clevis 404. A shoulder bolt 304 fixed to the finger body 132 cooperatively acts with the oblong opening 410. The opening 410 is provided so that when the clevis 404 is moved forward it contacts the guide shaft 302, which directs the finger 406 forward and along the path provided by the oblong opening 410, thereby radially extending or raising the finger 406.

The means for reciprocating the gripping means 115 includes a carriage 116, a pivot arm 110, and an urging means 120. In a preferred embodiment, the carriage 116 is slidably mounted on a track 106 provided on the top of a table 102 and extending the length of the table 102. The table 102 has legs 104 and a side bracket 108 parallel to the track 106 and connected to two of the legs 104. The carriage 116 has carriage mounts 124 that rotatably carry a roll inserter spindle 122. The carriage also has a guide pin 118 extending outward through an oblong opening 114 provided on the pivot arm 110 whose other end is rotatably supported on the side bracket 108 by support pin 112. The pivot arm 110 can be reciprocated or moved back and forth by the urging means 120, such as a pneumatic (hydraulic) cylinder, so that the means for gripping 131 and the roll inserter spindle 122 can be moved along a path having two ends; a first end or a forward position (shown in dashed lines in FIG. 1) and a second end or a retracted position (shown in solid lines in FIG. 1).

The front end of the roll inserter spindle 122 is connected to the means for gripping 131. The rear end has a means for rotating 126 used to rotate the spindle 122 and, in turn, the means for gripping 131. In addition, the spindle 122 has a push rod 128 located inside the spindle 122 and extending along its length.

In a preferred embodiment, the means for activating and deactivating the gripping means 125 comprises, a clevis 404, a push rod 128, and a means for reciprocating the push rod 130. The forward end of the push rod 128 is connected to the clevis 404. At the rear end of the push rod 128 there is the means for reciprocating the push rod 130, which moves the push rod 128 forward so that the clevis 404 cooperates with the finger 406 thereby radially extending or raising the finger 406.

Operation of the apparatus will be described. Plastic bags extruded in a continuous fashion may be further processed and are then wound onto a winding spindle to form a roll of bags 140. When the desired number of bags are on the roll, the winding is stopped. Typically, the roll will have a tendency to have a tail 142 hanging down.

In the meantime, while the roll inserter spindle 122 is at the second end or in the retracted position, an empty carton 150 is formed in a conventional and well known manner by a means for opening a folded carton. Thereafter, the spindle 122 and the finger body 132 are reciprocated through the empty carton 150 to the first end or forward position to butt up against the end of roll 140. The roll 140 is then stripped onto the finger body 132 by a stripping means, not shown.

The means for reciprocating the push rod 130 moves the push rod 128 forward causing the clevis 404 to contact the finger guide shaft 302 to radially extend or raise the finger 406 so that the distal end of the finger 406 securely grips the inside of the roll 140 (including its core, if any). The rotating means 126 rotates the spindle 122 in the required direction to wind up the tail 142 while the spindle 122 is being retracted, pulling the roll 140 into the carton 150.

When the roll 140 is in the carton 150, the means for reciprocating the push rod 130 moves the push rod 128 backward causing the clevis 404 to retract so that the finger 406 is retracted or lowered. Thereafter, the spindle 122 is fully retracted to a second end or retracted position from which the process may be repeated.

Of course, it should be understood that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of the invention.

We claim:

1. An apparatus that cooperates with a means for opening a folded carton for inserting a roll of material into an empty carton comprising:

a. means for gripping the inside of a roll of material;

b. means for reciprocating the gripping means along a path having two ends and a carton formation station in-between the ends; and, c. means for activating and deactivating said gripping means such that during reciprocation the gripping means grips the inside of a roll of material at a first end of the path and the roll is drawn into the open carton and the gripping means releases the roll at the carton formation station into the empty carton before proceeding to the second end of the path where the gripping means is outside the carton.

2. The apparatus of claim 1 further having a means for rotating the gripping means.

3. The apparatus of claim 1 where the gripping means consists of a finger body having a diameter smaller than the inside diameter of the roll, the finger body having a finger that radially extends beyond the body to contact and securely hold the roll.

4. The apparatus of claim 1 where the gripping means comprises a finger body having a diameter smaller than the inside diameter of the roll, the finger body having a finger that radially extends beyond the body to contact and securely hold the roll, the finger body further having a groove located in the finger body so that when the activating and deactivating means is deactivated the finger rests in the groove.

5. The apparatus of claim 4 where the finger is slightly angled inward at the distal end so that when the finger is radially extended the distal end is substantially parallel to the finger body.

6. The apparatus of claim 1 where the gripping means comprises a finger body having a diameter smaller than the inside diameter of the roll, the finger body having a finger, the finger body further having a clevis located near the proximal end of the finger body, one end of the clevis cooperatively connected to the finger and the other end of the clevis connected to the activating and deactivating means so that when the activating and deactivating means is activated the finger radially extends beyond the body to contact and securely hold the roll.

7. The apparatus of claim 6 further having:

a. two guide openings at the proximal end of the finger surrounding the clevis, b. an oblong opening provided above and forward of the guide openings, c. a finger guide shaft extending through the guide openings and the opening in the clevis, and d. a shoulder bolt fixed to the finger body to cooperatively act with the oblong opening so that when the activating and deactivating means is activated the finger radially extends beyond the body to contact and securely hold the roll.

8. The apparatus of claim 1 where the activating and deactivating means consists of a push rod with two ends, the first end being connected to the means for gripping, the second end being connected to a means for reciprocating the push rod.

9. The apparatus of claim 6 where the activating and deactivating means consists of a push rod with two ends, the first end connected to the clevis, and the second end connected to a means for reciprocating the push rod so that when the push rod is reciprocated the clevis cooperates with the finger radially extending the finger beyond the body to contact and securely hold the roll.

10. An apparatus that cooperates with a means for opening a folded carton for inserting a roll of material into an empty carton comprising:

a. a roll inserter spindle having a front end and a rear end;
b. means for reciprocating the spindle along a path having two ends and a carton formation station in-between the ends;
c. a push rod located inside the roll inserter spindle and extending the length of the spindle;
d. means for reciprocating the push rod;
e. a finger body connected at the proximal end to the front end of the roll inserter spindle;
f. a groove located on the finger body and extending substantially the length of the finger body;
g. a clevis located in the finger body near the proximal end and being connected to the push rod; and,
h. a finger with a first end resting in the finger body groove and a second end cooperatively connected to the clevis, such that during reciprocation of the spindle
   i) the push rod is reciprocated, forcing the clevis into cooperation with the finger such that the finger radially extends beyond the finger body to securely hold the roll of material at a first end of the path,
   ii) the roll is drawn into the open carton,
   iii) the push rod is reciprocated, causing the finger to release the roll at the carton formation station into the empty carton, and
   iv) the spindle proceeds to the second end of the path where the finger body is outside the carton.

11. The apparatus of claim 10 where the first end of the finger extends substantially the length of the finger body groove and is slightly angled downward near the distal end such that when the finger is radially extended the first end is substantially parallel to the finger body.

12. The apparatus of claim 10 further having, a. the second end of the finger extending downward from the first end and having two guide openings surrounding the clevis and corresponding to the opening of the clevis, the second end also having an oblong opening parallel with the second end and being forward and above the guide openings;
b. a finger guide shaft extending through one guide opening in the finger, the opening in the clevis and the other opening in the finger; and,
c. a shoulder bolt located forward and above the finger guide shaft and extending through the oblong opening in the finger to slidably guide the finger when the push rod is reciprocated, so that the finger moves forward along the path provided by the oblong opening thereby moving the finger to the raised position.

13. The apparatus of claim 10 having means to rotate the spindle.

14. The apparatus of claim 10 where the finger body is cylindrical.

15. The apparatus of claim 10 where the distal end of the finger body is tapered.

16. The apparatus of claim 10 further comprising:

a. a table with legs having a track on the top surface, the track running substantially the length of the table;
b. a side bracket below the top surface of the table, parallel to the track and connected to two parallel legs;
c. a pivot arm in the same plane as the side bracket, the arm having a first and a second end, the first end rotatably supported on the side bracket, the second end having an oblong opening with a tip of the oblong at the distal end;
d. a carriage having a top and a bottom, the bottom slidably mounted on the track, the top having the rear end of the spindle mounted thereon;
e. a carriage guide pin located on one side of the carriage and extending outward through the oblong opening in the pivot arm; and
f. a means for urging the pivot arm in a reciprocating fashion.

17. An automatic method of inserting a roll of material into an empty carton with opened opposing sides comprising:

a. moving a means for gripping the inside of a roll of material through the empty carton;
b. inserting the gripping means inside the roll of material;
c. gripping the roll of material to securely hold the roll;
d. drawing the roll of material into the empty carton;
e. releasing the roll of material; and,
f. retracting the gripping means away from the roll and carton.

18. The method of claim 17 where the gripping means consists of a finger body having a diameter smaller than the inside diameter of the roll, the finger body having a movable finger that radially extends beyond the body to contact and securely hold the roll.

19. The method of claim 17 where a means for opening a folded carton opens a folded carton before ripping means moves through the carton.

20. The method of claim 17 where the roll of material is formed around a core.

21. An automatic method of inserting a roll of material into an empty carton comprising:

a. forming a roll of material;
b. forming an empty carton;
c. moving a roll inserter spindle through the empty carton, the roll inserter spindle being connected to a finger body having a movable finger;
d. stripping the roll from the roll forming means onto the finger body;
e. radially extending the finger to contact the inside surface of the roll of material to securely hold the roll;
f. moving the roll inserter spindle through the empty carton to a position where the roll is inside the empty carton;
g. retracting the finger to release the roll; and, roll.
h. retracting the finger body from the 22. The method of claim 21 where the roll of material is formed around a core.

* * * * *